US005903946A

United States Patent [19]

Collins et al.

[11] Patent Number: 5,903,946

[45] Date of Patent: May 18, 1999

[54] PIPE CLEANING DEVICE

[75] Inventors: Peter John Collins; Vyvian Anthony Cox, both of Chester, United Kingdom

[73] Assignee: Shell Oil Company, Houston, Tex.

[21] Appl. No.: 09/000,591

[22] Filed: Dec. 30, 1997

Related U.S. Application Data

[63] Continuation-in-part of application No. 08/656,504, May 31, 1996.

[51] Int. Cl.[6] ..... B08B 9/04

[52] U.S. Cl. ..... 15/104.061; 15/104.068

[58] Field of Search ..... 15/104.05, 104.061, 15/104.063, 104.068, 104.069, 104.16, 104.2

[56] References Cited

U.S. PATENT DOCUMENTS

| | | | |
|---|---|---|---|
| 1,908,339 | 5/1933 | Frank | 15/104.061 |
| 2,273,347 | 2/1942 | Crane | 15/104.061 |
| 2,392,144 | 1/1946 | Hall | 15/104.061 |
| 2,609,556 | 9/1952 | Carver | 15/104.061 |
| 3,576,043 | 4/1971 | Zongker | 15/104.061 |

*Primary Examiner*—Terrence R. Till

[57] ABSTRACT

A pipe cleaning device comprises a central body and articulated scraper elements. The articulated shape of the scraper elements serves to enhance the cleaning performance of the device.

2 Claims, 2 Drawing Sheets

PIPE CLEANING DEVICE

This is a continuation-in-part of application Ser. No. 08/656,504 filed May 31, 1996, the entire disclosure of which is hereby incorporated by reference.

BACKGROUND OF THE INVENTION

The invention relates to a pipe cleaning device.

Pipe cleaning devices are widely used for cleaning the interior of pipes. These devices typically contain a sponge type body, bristles and/or scraper plates which remove debris from the inner surface of the pipe when the device is moved in an axial and/or tangential direction through the pipe.

The device may be moved through the pipe by pulling or pushing it therethrough by a wire or a rod, as is done if the device is a chimney-sweep, or by pumping fluid through the pipe, as is done if the device is a cleaning pig.

A pipe cleaning device in the form of a pig is disclosed in UK patent application GB 2273543. In the known device radially extending flexible scraping fingers are present which are slightly oversized relative to the internal diameter of the pipe so as to make resilient scraping contact with the inner surface of the pipe.

A disadvantage of the known device is that when it is moved through the pipe the scraping fingers will deflect such that debris which may be present on, or in pits in, the pipe wall is pressed against the wall by the finger and is therefore trapped and not removed.

SUMMARY OF THE INVENTION

An object of the present invention is to provide a pipe cleaning device which does not have the above cited disadvantage and which is able to clean a pipe wall to a high degree, even if the wall has an irregular surface.

The device of the invention comprises a central body and a plurality of scraper elements extending away from the central body, wherein at least some of the scraper elements have an articulated shape.

The device may form part of a cleaning pig which is transported through a pipeline by pumping fluid therethrough, which pig has a tubular central body that carries one or more sets of articulated scraper elements.

In such case it is preferred that

- a rear cup surrounds the tubular body at its rear end and a front cup surrounds the tubular body at its front end, which cups at least partly seal off the annular space between the central body and pipe wall when the device is in use;
- an internal disc baffle is mounted within the tubular body at a location between said discs such that said baffle at least partly seals off the interior of the tubular body,
- at least one set of articulated scraper elements is carried by the tubular body at a location between the rear cup and internal disc baffle; and
- a series of circumferentially spaced bypass openings are provided in the tubular central body between said rear cup and set of articulated scraper elements and between said internal disc baffle and said front cup.

If the device forms part of a cleaning pig it is furthermore preferred that, in order to rotate the pig when it is pumped through a pipe, the outer surface of the front cup is provided with a plurality of helical grooves and the tubular body further carries a series of helical scraper blades.

DESCRIPTION OF THE DRAWINGS

These and other features, objects and advantages of the present invention will become apparent from the accompanying claims, abstract and drawings, in which

DETAILED DESCRIPTION OF THE INVENTION

Figure 1:
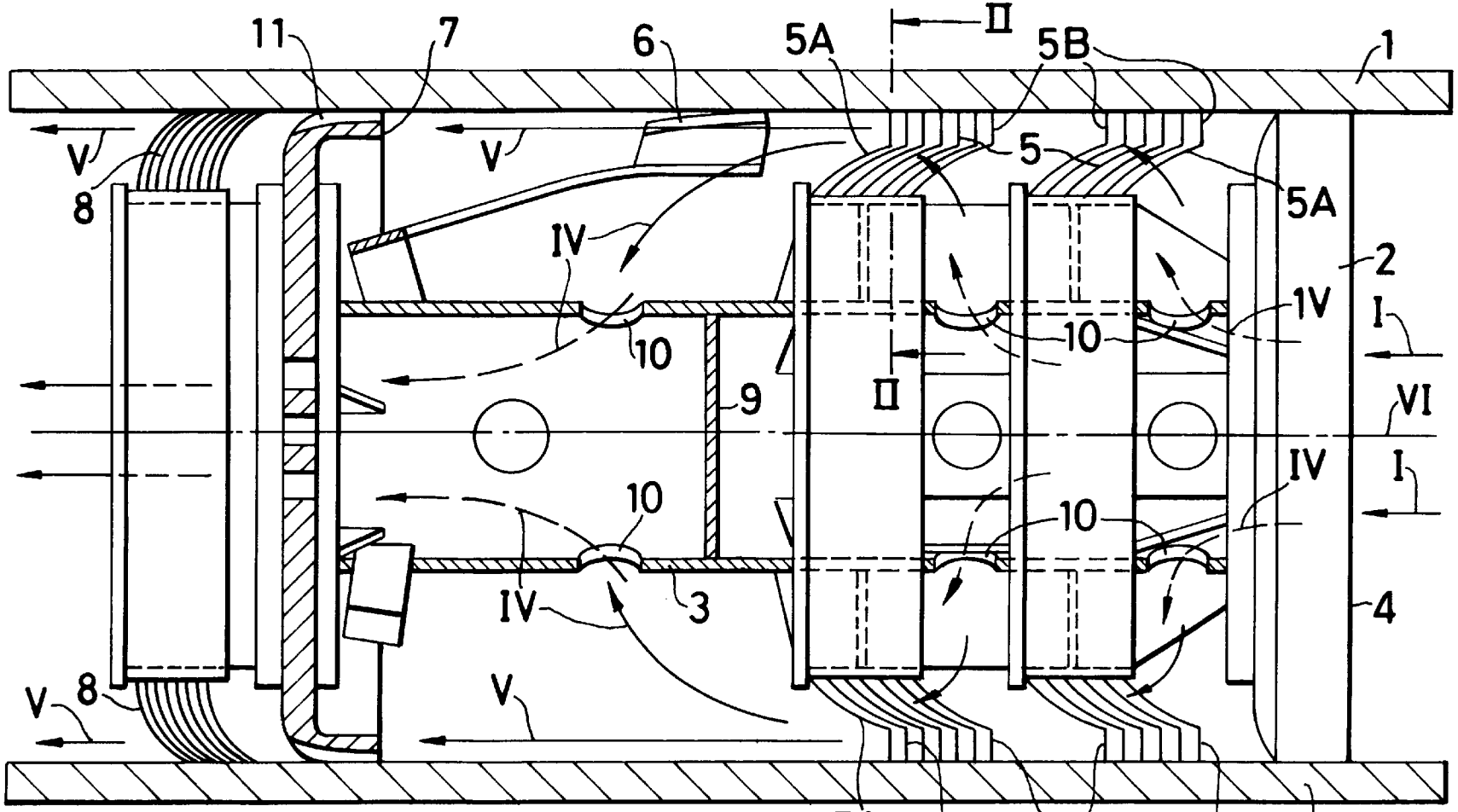
FIG. 1 shows a schematic, partly side and partly longitudinal sectional view of a cleaning device according to the present invention within a pipe.

Referring now to FIG. 1, there is shown a longitudinal section of a pipe 1 through which a cleaning device 2 according to the invention is moved in the direction of the arrows I by pumping fluid through the pipe 1 in the direction of these arrows I.

The device 2 comprises a tubular central body 3 on which a rear cup 4, two sets of articulated scraper elements 5 according to the invention, a set of helical scraper vanes 6, a front cup 7 and a set of conventional scraper elements 8 are mounted.

The conventional scraper elements 8 and the articulated scraper elements 5 are both slightly oversized with respect to the internal pipe diameter. The resulting deflection of the conventional scraper elements 8 will cause any debris which may be present on, or in pits of, the inner surface of the pipe 1 to be trapped between the tips of the elements 8 and the pipe wall, which reduces the cleaning performance.

The length of the articulated scraper elements 5 is selected such that primarily the foot sections 5A thereof are induced to deflect such that the tip sections 5B thereof engage the inner surface of the pipe 1 in a substantially radial direction. Using scraper elements which each have a foot section that is about three to four times longer than a tip section has been seen to induce the desired deflection. As a result of the radial orientation of the tip sections 5B no debris is trapped between these tip sections 5B and the pipe wall and the tip sections 5B will penetrate even into small pits in the pipe wall.

The cleaning performance of the device 1 is further enhanced by allowing some of the fluid to bypass the device 1 such that the fluid flushes any debris from the surface of the scraper elements 5 and 8.

This is accomplished by providing the rear cup 4 with an open or perforated center (not shown) through which fluid enters the interior of the tubular central body 3. Furthermore an internal disc baffle 9 is mounted between the sets of articulated scraper elements 5 and the front cup 7 and perforations 10 are present between the rear cup 4 and each of the sets of articulated scraper elements 5 and between the baffle 9 and the front cup 7. As can be seen in FIG. 1 the perforations 10 and baffle 9 induce fluid to flow in the direction of the arrows IV thereby flushing and cleaning the scraper elements 5.

The outer surface of the front cup 7 is provided with a series of helical grooves 11. During operation of the device 1 some of the fluid will flow through these helical grooves 11 and between the helical scraper blades 6 in the direction of arrows V in a swirling motion, which enhances the cleaning of the pipe wall.

Figure 2:
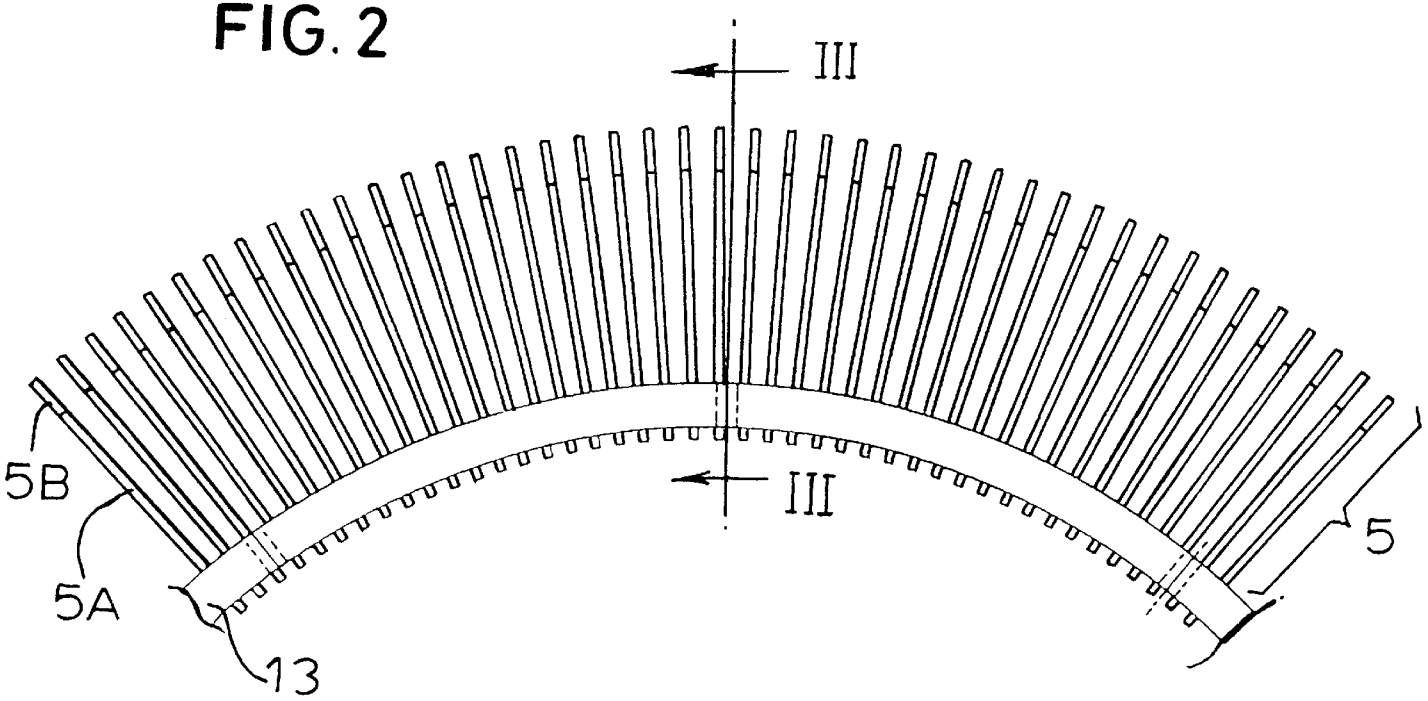
FIG. 2 shows a cross-section of part of the cleaning device of FIG. 1, taken along line II—II and seen in the direction of the arrows.
Figure 3:
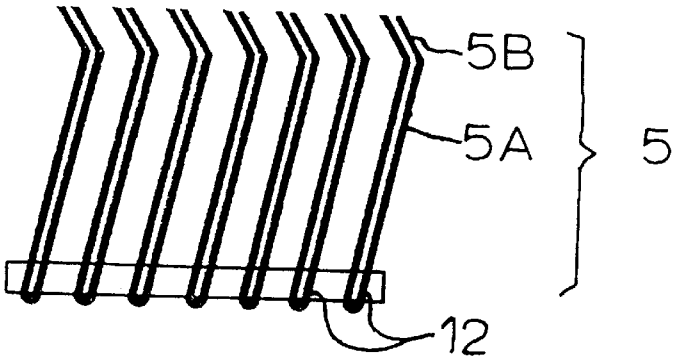
FIG. 3 shows a longitudinal section of part of the cleaning device of FIG. 1 and 2, taken along line III—III and seen in the direction of the arrows.

FIGS. 2 and 3 show the upper part of one set of articulated scraper elements 5 in an expanded position.

The elements 5 consist of elongate metal strips which are folded in a U-shape and stabbed through openings 12 in a scraper carrier ring 13 which is welded co-axially around the tubular central body 3 of the device.

The openings 12 are drilled in a regular pattern through the ring 13 such that the scraper elements 5, when seen in the direction of the central axis VI of the central body 3 as shown in FIG. 2, are located at regular tangential spacings.

Furthermore, the openings 12 are drilled in a slant orientation through the ring 13 such that, when seen in a cross-axial direction as shown in FIG. 3, the foot sections 5A of the scraper elements 5 are oriented at an acute angle of between 70 and 80 degrees relative to the central axis VI and point towards the rear cup 4.

The articulated scraper elements 5 are each pre-shaped by bending the element 5 during the manufacturing process of the device 1 and before the device is inserted in a pipeline such that a tip section 5B is defined which is oriented at an angle of between 40 and 50 degrees with respect to the foot section 5A of the element in question and such that the tip section 5B points towards the front cup 7.

The articulated shape of each scraper elements 5 causes the elements to deflect into the position shown in FIG. 1 when the device is pumped through the pipe 1 such that the tip sections 5B engage the pipe wall in a substantially radial direction.

It will be understood that instead of using metal strips for forming the articulated scraper elements any other resilient material may be used as well. If desired, the scraper elements may consist of articulated rods of a plastic material.

Furthermore instead of pumping the device through a pipe it may pulled or pushed therethrough by a rope or a rod.

These and other modifications and alternative embodiments will become apparent to those skilled in the art of pipeline maintenance and inspection upon reading this description and accompanying claims. Accordingly, it is to be understood that the embodiment of the pipe cleaning device depicted in the accompanying drawings is illustrative only and should not be construed as a limitation to the appended claims.

What is claimed is:

1. A cleaning device comprising a tubular central body and at least one set of angular scraper elements extending away from the central body, each said angular element having a tip section and a foot section;

wherein the length of each angular scraper element is selected such that when the device is located within a pipe the elements are induced to deflect such that the tip sections engage an inner circumference of the pipe in a substantially radial direction;

for each angular element the foot section is about three to four times longer than the tip section;

the angular scraper elements consist of elongate flexible strips which are bent at about the same distance from the central axis of the central body;

the device forms part of a cleaning pig which is transported through a pipeline by pumping fluid therethrough, which pig has a tubular central body that carries at least one set of angular scraper elements;

the tubular central body has a front end and a rear end, a rear cup surrounds the tubular body at said rear end and a front cup surrounds the tubular body at said front end, which said front and rear cups at least partly seal off the annular space between the central body and pipe wall when the device is in use;

an internal disc baffle is mounted within the tubular body at a location between said discs such that said baffle at least partly seals off the interior of the tubular body;

at least one set of articulated scraper elements is carried by the tubular body at a location between the rear cup and internal disc baffle; and a series of circumferentially spaced bypass openings are provided in the tubular central body between said rear cup and set of angular scraper elements and between said internal disc baffle and said front cup.

2. The cleaning device of claim 1, wherein the outer surface of the front cup is provided with a plurality of grooves and the tubular body further carries a series of scraper blades.

* * * * *